US006530185B1

(12) United States Patent
Scott et al.

(10) Patent No.: US 6,530,185 B1
(45) Date of Patent: Mar. 11, 2003

(54) BUCK FOR USE WITH INSULATED CONCRETE FORMS

(75) Inventors: G. Richie Scott, Ontario (CA); Jan H. Mensen, Barcelona (ES)

(73) Assignee: Arxx Building Products, Inc., Ontario (CA)

( * ) Notice: Subject to any disclaimer, the term of this patent is extended or adjusted under 35 U.S.C. 154(b) by 0 days.

(21) Appl. No.: 09/127,792

(22) Filed: Aug. 3, 1998

(51) Int. Cl.[7] ..... E04B 1/04

(52) U.S. Cl. ..... 52/215; 52/213; 52/425; 52/427; 52/656.5; 52/105; 52/656.9; 249/30

(58) Field of Search ..... 52/215, 425, 426, 52/427, 213, 424, 309.12, 564, 309.11, 562, 592.1, 565, 105, 568, 604; 49/504; 249/39

(56) References Cited

U.S. PATENT DOCUMENTS

| | | | | | |
|---|---|---|---|---|---|
| 1,184,373 | A | | 5/1916 | Olberg et al. | |
| 1,741,776 | A | | 12/1929 | Isaacson | |
| 1,808,337 | A | | 6/1931 | Baum | |
| 1,835,587 | A | | 12/1931 | Baum | |
| 2,787,820 | A | | 4/1957 | Shields et al. | |
| 3,130,455 | A | | 4/1964 | Borlenghi | |
| 3,469,350 | A | * | 9/1969 | Lange | 52/213 |
| 3,769,769 | A | * | 11/1973 | Kohl | 52/212 |
| 3,924,373 | A | * | 12/1975 | Lizdas et al. | 52/213 |
| 3,995,843 | A | | 12/1976 | Kasteler | |
| 4,028,849 | A | * | 6/1977 | Anderson | 49/181 |
| 4,034,513 | A | * | 7/1977 | Richardson | 49/504 |
| 4,223,494 | A | * | 9/1980 | Wendt | 52/211 |
| 4,430,831 | A | | 2/1984 | Kemp | |
| 4,443,984 | A | * | 4/1984 | Rasmussen | 52/213 |
| 4,589,624 | A | | 5/1986 | Jones | |
| 4,614,068 | A | * | 9/1986 | Bergthold | 52/211 |
| 4,674,248 | A | * | 6/1987 | Hall | 52/212 |
| 5,090,168 | A | | 2/1992 | Fast et al. | |
| 5,169,544 | A | | 12/1992 | Stanfill et al. | |
| 5,390,459 | A | | 2/1995 | Mensen | |
| 5,657,600 | A | | 8/1997 | Mensen | |
| 5,709,808 | A | | 1/1998 | Lee | |
| 5,845,449 | A | * | 12/1998 | Vaughan et al. | 52/565 |
| 5,881,510 | A | * | 3/1999 | Ole | 52/217 |
| 5,896,714 | A | * | 4/1999 | Cymbala et al. | 52/426 |
| 5,918,427 | A | * | 7/1999 | VanderWerf | 52/100 |
| 5,996,293 | A | | 12/1999 | Anderson et al. | |
| 6,070,375 | A | | 6/2000 | Anderson et al. | 52/204.54 |

FOREIGN PATENT DOCUMENTS

| | | |
|---|---|---|
| CA | 2255256 | 1/2000 |

OTHER PUBLICATIONS

Vinyl Technologies, Inc., "Things Just Got a Lot Easier: Introducing VBUCK II: Made Especially for ICF Products", *V–Buck Brochure*, Jun. 25, 1998.

AAB Building Systems, Inc., "Door and Window Openings", *Blue Maxx Technical Manual*, pp. 2–16 thru 2–20, 1998.

* cited by examiner

*Primary Examiner*—Carl D. Friedman
*Assistant Examiner*—Jennifer I. Thissell
(74) *Attorney, Agent, or Firm*—Morgan, Lewis & Bockius LLP

(57) ABSTRACT

The invention relates to a buck for forming and framing the perimeter of an opening in an insulated concrete form wall. The buck is formed of insulating material compatible with the concrete form, such as plastic, and forms a friction fit with supporting portions of the form wall to provide a seal therebetween. The buck may have a portion for receiving fasteners to secure a component mounted on the buck, thus facilitating the attachment of components to the buck within the wall opening, and reducing or completely eliminating the need for fasteners to penetrate hardened concrete. The buck may also include a separate portion, preferably integrated with the fastening portion, that provides for increased thermal insulation. The buck may also include anchoring fins around which the poured concrete may harden to securely attach the buck to the wall and enhance the seal therebetween.

24 Claims, 7 Drawing Sheets

BUCK FOR USE WITH INSULATED CONCRETE FORMS

BACKGROUND OF THE INVENTION

1. Field of the Invention

The invention relates generally to building systems, and more particularly, to an improved apparatus and method for forming a framed opening in a poured concrete wall made with insulated concrete forms, for example, that remain a permanent part of the wall.

2. Discussion of the Related Art

Conventional building construction utilizes concrete foundation walls which are normally produced by constructing form walls, pouring concrete into the space between the walls and, upon setting of the concrete, removing the form walls. Finishing materials are then added to the concrete foundation walls as required. Framing members, often made of wood, will then be constructed on top of the foundation walls. Insulation may then be inserted between the framing members and the wall finished inside and out as desired.

More recent building systems involve the use of insulated concrete forms (ICF's) which comprise a foam insulating material to construct permanent concrete form walls. The form walls are constructed by placing separate building components upon each other. The concrete is then poured and the form walls are left in place, even after the concrete hardens. The concrete wall so formed need not be confined to foundation walls but may comprise all of a building's walls. Generally, no further insulation is necessary, and known finishing materials of all types, including veneer finishes, stucco, gypsum boards, etc., may be applied to the interior and exterior of the wall as required. An example of a particularly advantageous type of ICF appears in U.S. Pat. No. 5,390,459 (Mensen) and U.S. Pat. No. 5,657,600 (Mensen), the disclosures of which are incorporated by reference herein in their entirety. As shown in FIG. 1, the ICF's of these patents are made from a building component 10, which includes first and second high density foam sidepanels 12 and 14. The sidepanels 12 and 14 are preferably made of expanded polystyrene and are arranged in spaced parallel relationship with their inner surfaces facing each other. Plastic bridging members 42 molded into the sidepanels hold them together against the forces applied by the poured concrete. Each bridging member includes end plates 44, 46, which line up when the components are stacked to form furring strips for attachment of finishing materials. As these building components 10 are stacked to become an ICF form wall, it becomes necessary to provide block-out systems known in the art as "bucks" to provide openings for installing components, such as windows or doors, within the ICF form wall.

In conventional, pre-ICF, concrete building systems discussed above, wood or metal bucks have been utilized to provide such a block-out opening in the wall. Many of these conventional bucks are removable once the concrete has hardened, similar to the wood forms used in these pre-ICF building systems, and are referred to within the construction art as "reusable bucks". Examples of reusable buck systems are disclosed in U.S. Pat. No. 2,787,820 (Shields et al.) as well as in U.S. Pat. No. 5,169,544 (Stanfill et al.).

With the advent of the use of stay-in-place forms or permanent concrete formwork, such as ICF's, the current practice has been to build a wooden framed buck to provide an opening in the wall for installing a component, such as a window or a door. This frame is typically constructed from standard-sized lumber such as 2"×12" or 1"×12". If left in place after the poured concrete has cured, this wooden frame of the buck provides a fastening surface for the window or door and its finishing trim.

An example of such a known window buck in an ICF wall is denoted generally as 23 in FIG. 2, which shows the use of, for example, 2"×12" lumber 25 to create the top and sides of the buck. The wooden buck retains the concrete and also provides solid attachment surfaces for interior and exterior finishes around the edge of the openings. The bottom 27 of the buck frame may be created with two 2"×4"'s in an arrangement which will provide a slot to allow proper placement and consolidation of concrete below the opening. In order to keep the wood frame properly aligned in the opening within the stacked wall forms, 1"×4" wood strapping 29 may be fastened to the perimeter facings of the frame as shown in FIG. 2. This will ensure alignment of the wall forms with the wood frame. The 1"×4" strapping 29 may be removed and reused once the concrete has set.

When the wooden buck frame is to be left in the wall, it must be firmly secured to the concrete. The frame may be fastened to the concrete by using fasteners, such as nails or anchor bolts, secured to the frame and left hanging between the sidepanels of the ICF system. The subsequent pouring of wet concrete between the two sidepanels will cause the wet concrete to flow around the fastener and thus aid in holding the frame in place once the concrete has hardened.

The opening formed by a wood buck for a window and door opening typically require supplemental bracing inside the frame to prevent deflection of the wood members under pressure from the poured concrete. This can be accomplished, for example, by placing one or more pieces of lumber in the opening to brace from side to side and/or from top to bottom. Other bracing arrangements commonly used in the building construction arena utilize dimensional lumber (i.e. 2"×4", 2"×6", or 2"×8", for example). Fiber tape has also been utilized to secure, or assist in securing, the attachment of the buck to the form while the concrete is setting.

The wooden construction of these conventional bucks results in a variety of problems because of the inherent qualities of wood. For example, wood may change dimensions over time as a result of variations in humidity and temperature. This results in a common problem known in the construction field as buck shrinkage, which can affect the thermal performance of the wall and the attached component. If the conventional buck frame members undergo buck shrinkage, they may cup, warp and/or twist. This frequently results in cracks in the wall providing opportunities for air infiltration thereby compromising the thermal performance of the walls. Moreover, the use of wooden framed bucks may lead to significant problems resulting from insect infestation. Also, the wood frame has low thermal insulative properties, which is becoming an increasingly significant issue in modem construction.

Current stay-in-place bucks, such as that shown in FIG. 2, use fasteners such as nails or screws to attach the window, door, or other component to be mounted within the opening to the buck. The fasteners connect the mounted component to the buck and are anchored either within the wooden buck frame itself or within the adjacent concrete of the building wall. While such an attachment method is feasible, it is often difficult to anchor fasteners within the hardened concrete of the building wall. Moreover, the inherent dimensional instability and other detrimental qualities of wood, including those discussed above, can result in undependable alignment of the mounted component within the form wall system, as well as cracking of interior wall finishing, such as dry wall. Moreover, the cost of constructing such wooden retainers in terms of material and labor is high, especially when constructing a large commercial building, or other structure with many wall openings.

As a result of the foregoing problems and disadvantages, there is a need in the building construction art for a more efficient, cost-effective and reliable apparatus and method for forming a framed opening in a poured concrete wall made with permanent concrete formwork, such as ICFs, which will provide dependable containment of wet concrete within the wall during curing, improve the structural stability of the overall building wall system, facilitate the attachment of components, such as windows and doors, within the wall opening, and overcome the problems inherent with currently used wood block-out wall opening systems.

SUMMARY OF THE INVENTION

The invention solves these problems and avoids the drawbacks and disadvantages of the prior art by providing a buck formed of insulating material compatible with the concrete form, such as plastic, that forms a friction fit with supporting portions of an insulated concrete form wall. As a result, the buck is more stable during construction and better able to dependably contain wet concrete within the wall during curing than prior art bucks. The buck of the invention may have a portion for receiving fasteners to secure a component mounted on the buck, thus facilitating the attachment of components to the buck within the wall opening, and reducing or completely eliminating the need for fasteners to penetrate hardened concrete. The buck may also include a separate portion, preferably integrated with the fastening portion, that provides for enhanced thermal insulation. The buck may also include anchoring fins around which the poured concrete may harden and securely and sealingly attach the buck to the form.

To achieve these and other advantages and in accordance with the purpose of the invention, as embodied and broadly described and according to a first aspect of the invention, a buck is provided for forming and framing the perimeter of an opening in an insulated concrete form wall and attaching a component mounted in the opening to the wall. This buck includes first and second portions configured to engage spaced portions of an insulated concrete form wall forming the perimeter of the opening; a fastening section for attaching a component to the buck; and an insulating section.

The fastening and insulating sections may be formed by a plurality of air chambers defined by walls of a multi-layer structure, which receive and retain fasteners, preferably entirely within the chambers to avoid having to penetrate the hardened concrete. An anchoring portion, such as a T-shaped fin, may be provided to hold the buck in the concrete and, with the frictional engagement of the buck and the ICF, sealingly attach the buck and the ICF together. Preferably, the buck is formed from plastic material and includes ribs and/or score lines for facilitating construction by increasing friction between the buck and component to be mounted and/or providing indicia locating placement of fasteners and/or cutting lines to remove a portion of the buck when certain types of finishing materials, like stucco, are to be applied. With the buck of the invention, the component may be center or flange (side) mounted within the opening, as with conventional wood bucks.

In a further aspect of the invention, a method of making framed openings in a poured concrete wall made with permanent concrete formwork, is provided. This method includes the steps of constructing permanent concrete formwork having an opening; providing plastic bucks having at least one insulating chamber; frictionally attaching the bucks to the perimeter of the concrete formwork forming the opening; and pouring concrete into the formwork. A window, door, or other wall component may be directly mounted to the buck by fasteners, preferably received entirely within the buck. The bucks may include insulating air chambers within which the fasteners are received. Also, a finishing material may be directly attached to the buck.

Additional features and advantages of the invention will be set forth or be apparent from the description that follows. The features and advantages of the invention will be realized and attained by the structures and methods particularly pointed out in the written description and claims hereof as well as the appended drawings.

It is to be understood that both the foregoing general description and the following detailed description are exemplary and explanatory and are intended to provide explanation and context for the invention, the scope of which is limited solely by the appended claims.

BRIEF DESCRIPTION OF THE DRAWINGS

The accompanying drawings, which are included to provide a further understanding of the invention and are incorporated in and constitute a part of this specification, illustrate embodiments of the invention and together with the detailed description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 2:
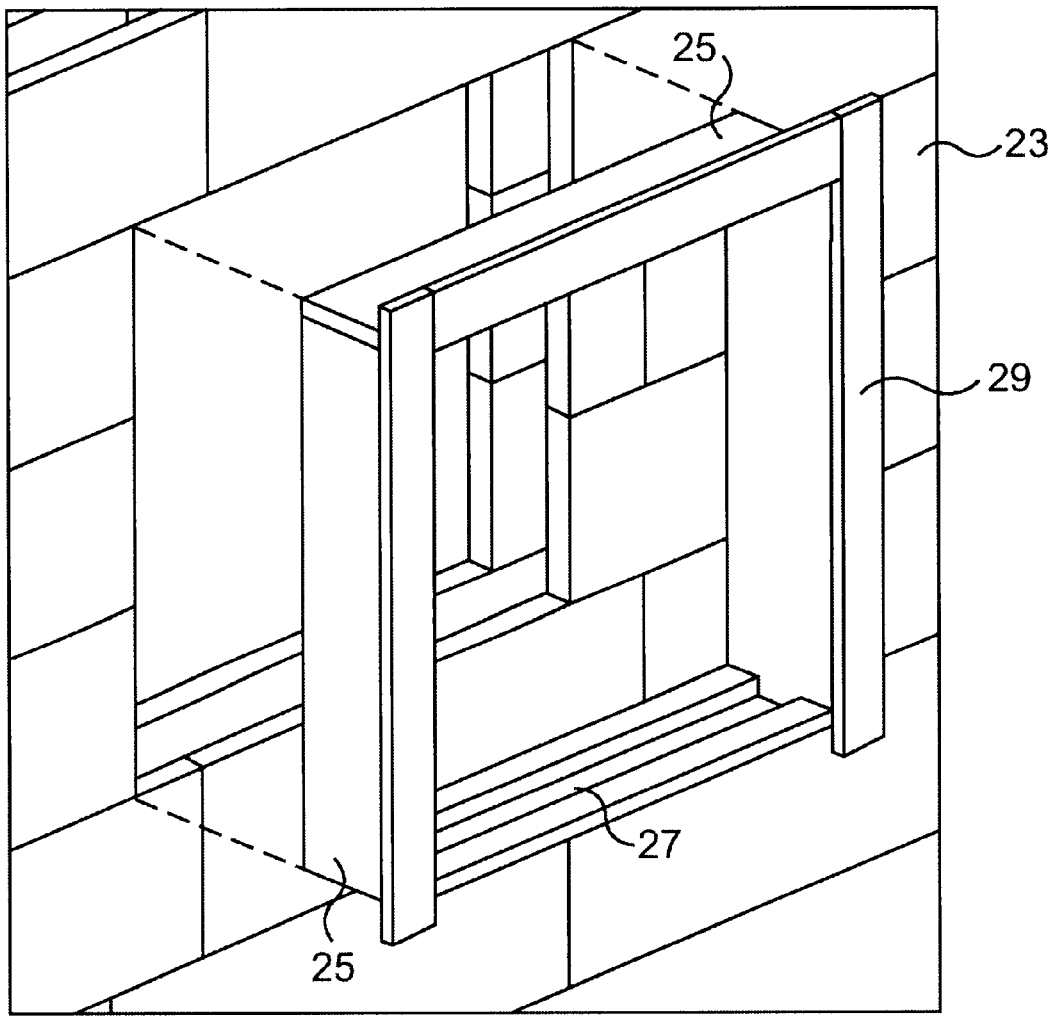
FIG. 2 PRIOR ART
FIG. 2 is a perspective view of a conventional wooden buck used to form an opening within an insulated concrete form building wall.
Figure 3:
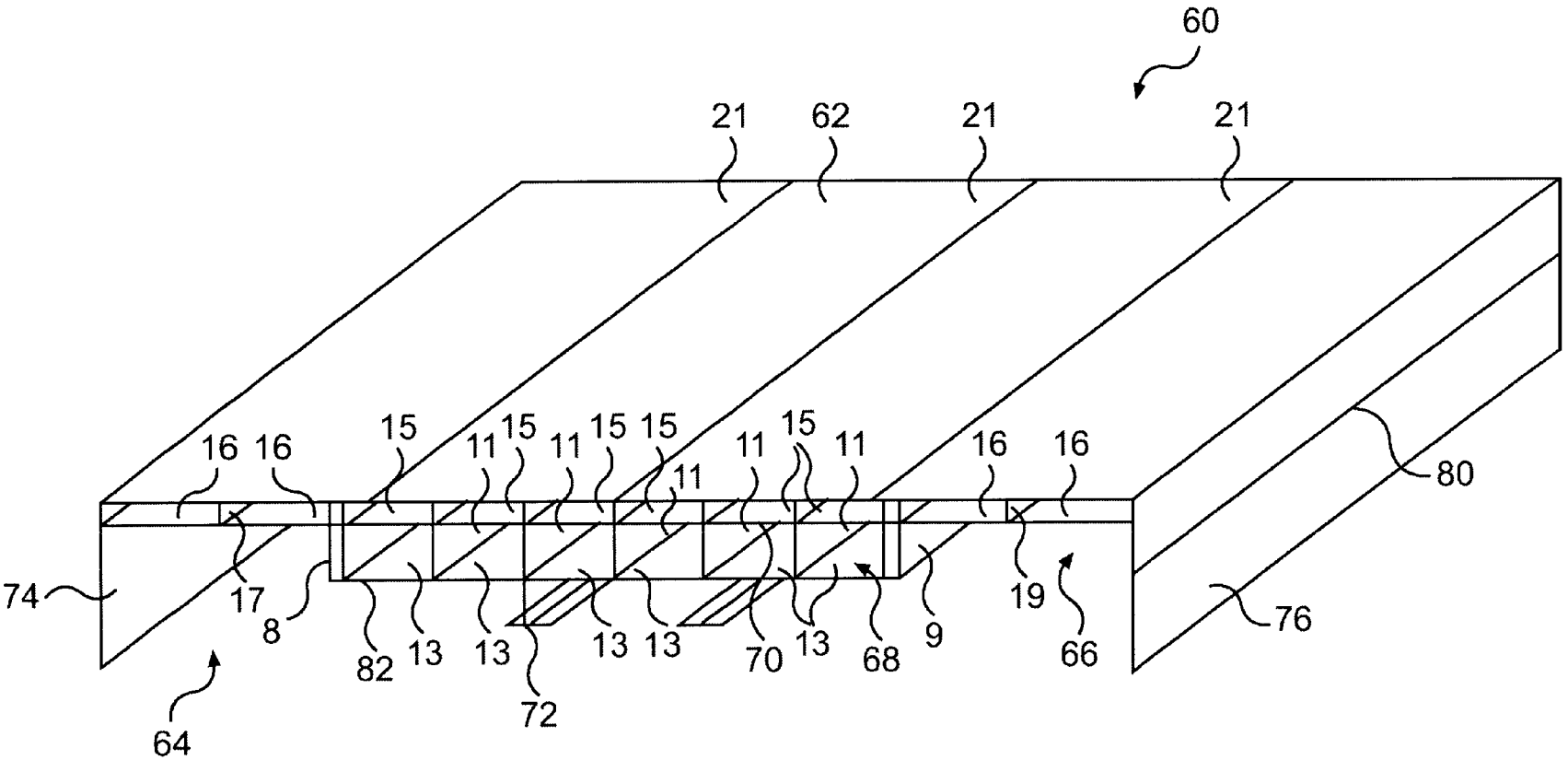
FIG. 3 is a schematic perspective view of a buck constructed according to the principles of a first embodiment of the invention.
Figure 4:
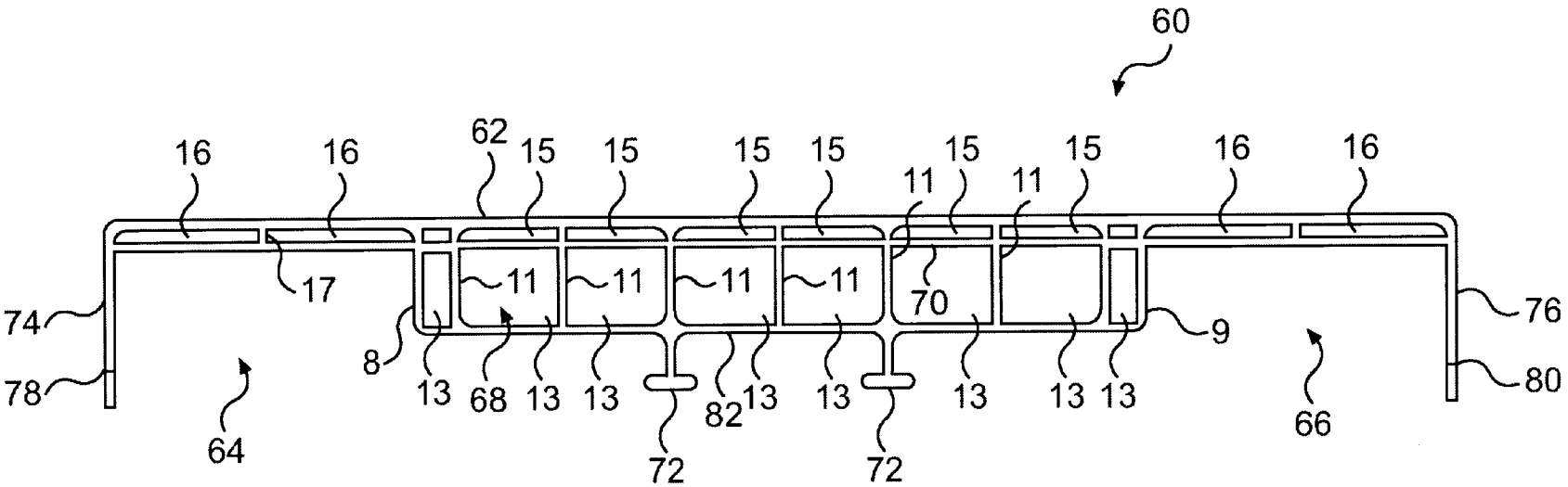
FIG. 4 is a transverse, cross-sectional view of the buck of FIG. 3.

FIG. 3 is a schematic perspective view of a buck 60 constructed in accordance with the principles of the invention. FIG. 4 is a cross-sectional view of the buck 60 of FIG. 3. Buck 60 is designed for forming a framed opening in a poured concrete wall made with insulated concrete forms having first and second parallel and spaced sidepanels of the type shown in FIG. 1 and described in more detail in U.S. Pat. Nos. 4,390,459 and 5,657,600, the disclosures of which have been incorporated by reference herein in their entirety. The opening may be a window opening such as illustrated in FIG. 2, a door opening, or any other opening into which wall components are to be mounted. As described in more detail below, in practice a plurality of bucks 60 are placed around the sides, top and bottom of the opening, similar to the wooden buck arrangement illustrated in FIG. 2.

The buck 60 includes a top wall 62 having a surface for supporting a component to be mounted within the wall opening. At the sides of buck 60, flanges 74, 76 depend downwardly from top wall 62 to form first and a second sidepanel receiving sections 64, 66.

Figure 7:
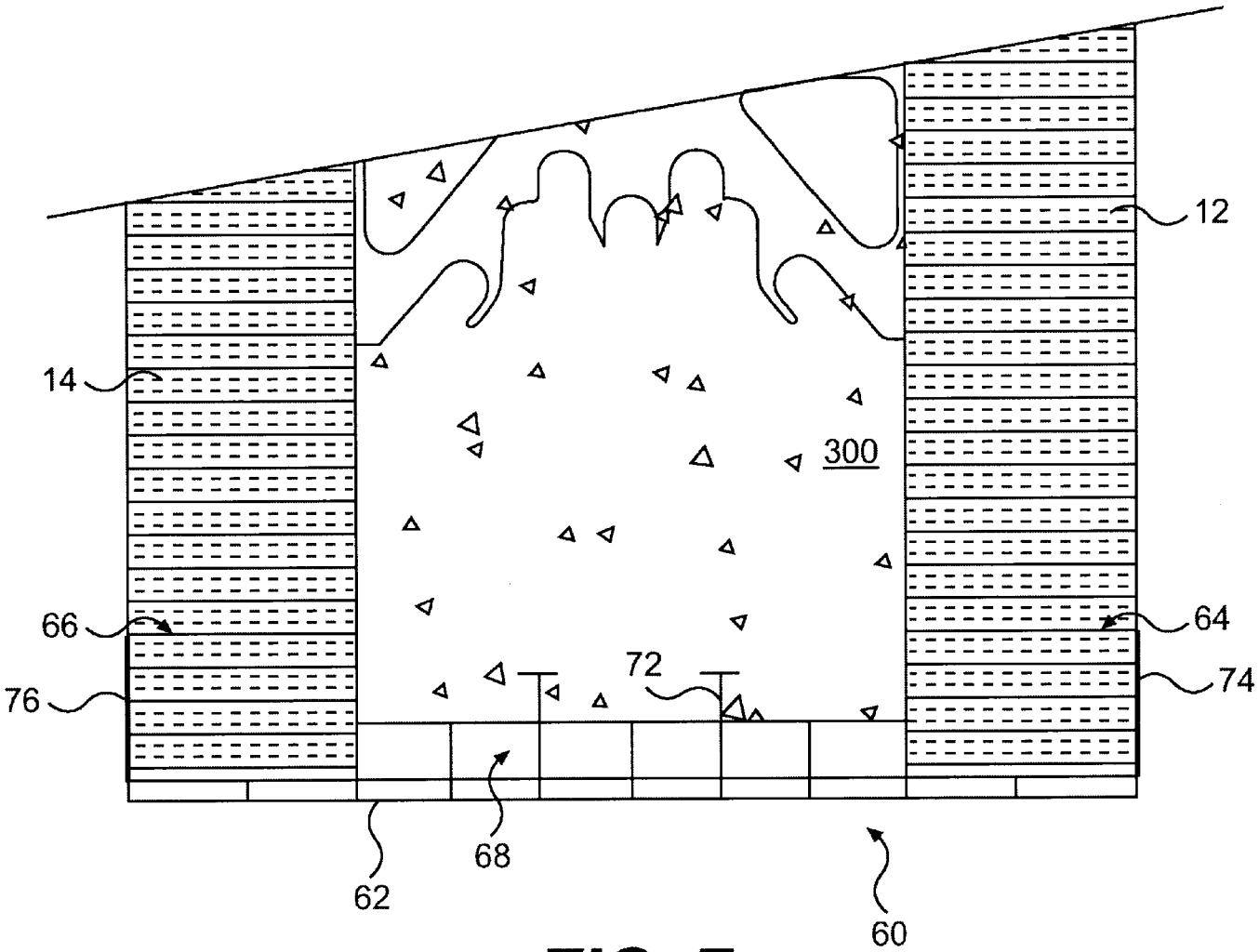
FIG. 7 is a transverse, cross-sectional view schematically showing a buck of the invention mounted to an ICF building component.

Flanges 74, 76 are separated from each other by top wall 62 a sufficient distance such that the inner surfaces of flanges 74, 76 engage the outer surfaces of sidepanels 12, 14 with a friction fit, as illustrated best in FIG. 7, which shows the buck 60 in place mounted to and spanning across the space between the sidepanels. Although the flanges 74, 76 are shown in FIG. 3 as forming right angles (90°) with top portion 62, the flanges may be formed at angles slightly less than 90°, such that they tilt inwardly, to increase the frictional force between the flanges and sidepanels. A good friction fit is advantageous because it holds the entire wall and buck assembly in place during construction, thereby facilitating dimensional stability and installation. This friction fit also forms a seal to contain the concrete within the formwork at the wall openings during the period that the concrete has not yet completely cured and is still wet. At the middle of the buck a multi-chambered section 68 is provided, as described in more detail below, which also downwardly depends from top wall 62. The outermost ends of multi-chambered section 68 are formed by walls 8, 9 which extend generally parallel to flanges 74, 76, respectively. The ends of the sidepanels 12, 14 may be trapped and engaged between wall 8 and flange 74, and wall 9 and flange 76, respectively, to increase the frictional fit and seal between the buck 60 and sidepanels 12, 14.

Multi-chambered section 68 thus is disposed between the first and section sidepanel receiving sections 64 and 66 underneath the top wall portion 62. Section 68 has two main purposes, which are to act as a thermal insulator and to receive and anchor fasteners for securing the component to be mounted within the opening (typically a door or a window) to the buck 60. Thus, section 68 includes a plurality of air chambers 13, which act as insulators similar to the chambers provided in conventional vinyl windows. Chambers 13 are defined by a series of longitudinally extending inner walls 11 extending generally parallel to outer walls 8, 9 and a bottom wall 82 extending between outer walls 8, 9. The ends of chambers 13 are open to permit air to be contained therein. A middle wall 70 may be disposed between and generally parallel to top wall 62 and bottom wall 82 to form additional chambers 15. Middle wall 70 may even extend outwardly to flanges 74, 76 to form further insulating air chambers 16 between flanges 74, 76, outer walls 8, 9 and top wall 62. Further intermediate walls 17, 19 may be provided to divide chambers 16 further into smaller, separate chambers. An increased number of chambers results in increased thermal performance.

The inner chambers 13, 15 also provide an alternative to securing fasteners for mounting the component within the buck frame to the concrete itself, as is done with conventional wood bucks. Especially if the concrete has already hardened, it can be difficult to secure the component to the buck using the conventional method. By disposing the chambers adjacent to each other in at least two rows, the fasteners are more securely attached because they pass through two mounting surfaces, the top wall 62 as well as the middle wall 70.

Referring still to FIGS. 3 and 4, the buck 60 may also be provided with a pair of anchoring fins 72 depending downwardly from the bottom wall 82 of section 68 to hold the buck in place once the poured concrete around the anchoring fins 72 hardens. Although variously shaped anchoring fins could be used, a fin having a transverse member, such as the head of the T-shaped anchoring fins 72, has been found to be advantageous to form a secure retainment anchor within the concrete as it hardens around the fin. The combination of the friction fit between the ends of the sidepanels and the buck, and the anchoring fins within the concrete, contribute to providing enhanced sealing between the buck and the ICF to increase the structural stability of the wall system, enhance the thermal performance of the wall system, and reduce the opportunity for air infiltration and air exfiltration between the buck and the cured concrete.

In order to avoid the problems discussed above in connection with regard to wooden framed bucks, the buck of the invention preferably is made of an insulating material, such as plastic. While a variety of such materials may be used, a currently preferred plastic is polyvinyl chloride (PVC) because of its high thermal insulating properties, strength, and relatively low costs. Either recycled or virgin PVC may be used as the insulating material. The PVC buck of the invention may be made in a variety of ways such as extrusion or injection molding, with extrusion being preferred currently for cost considerations. The buck may also be made of other insulative materials.

A plastic buck offers further advantages in that plastic is similar to the material used in the ICF form, and is also similar to a vinyl material, from which windows are typically formed in modem construction. As a result, the various pieces making up the final form wall with openings will advantageously expand and contract similarly.

As shown in FIGS. 3 and 4, outer flanges 74, 76 each may include a score line 78, 80 for indicating a cutting location. For example, when applying stucco finish or cladding to the foam panels of the EPS system, the outer flanges 74 and 76 of the installed buck 60 could interfere with the secure attachment of the stucco to the external sidepanels 12 and 14 of the building component. To facilitate removal of a portion of these outer flanges 74 and 76, score lines 78, 80 indicate where to cut the outer flanges 74, 76.

The component (door, window, etc.) to be mounted to the buck 60 may be either centermounted to the top wall 62 or flange-mounted to top wall 62 adjacent to the outer flange 74 or 76. In a center mounted arrangement, the component to be mounted is fastened to the top wall 62 at a location over the insulating section 68. A fastener, such as a screw, passes from the component to be mounted through the top wall 62 into the air chambers and, in the embodiment shown in FIGS. 3 and 4, through the middle wall 70. The end of the fastener can then rest above wall 82 within the insulating section 68. As a result, the wood securement problems of the prior art are avoided by providing a secure attachment location directly to the plastic buck. Moreover, there is no need to attempt to secure the fastener within the hardened concrete as the walls and chambers of the insulating section 68 also form a convenient fastener receiving section above the hardened concrete. However, if desired for any particular reason, it is possible to allow the fastener to pass through the bottom wall 82 for securing into the concrete itself.

The top wall 62 may be formed with linear, raised surfaces or ribs 21, which serve several purposes. First, the two outer ribs 21 indicate the outer extent of the fastener receiving section, so an installer knows to locate the fasteners within the area defined by these ribs. The middle rib 21 indicates the longitudinal center of the buck. Ribs 21 also serve to increase the frictional forces between the outer surface of top wall 62 and the component (e.g., a window) to be mounted thereto.

In a flange mounted arrangement, the component to be mounted is placed on the top wall 62, adjacent to one of outer flanges 74 and 76. A bracket or the like attached to the component to be mounted will lie parallel and flush against an outer flange. A fastener, such as a nail or a screw, may then be passed though the outer flange and through the adjacent sidepanel 12, 14 now mounted within the sidepanel receiving section 64 or 66, as shown best in FIG. 7. The fastener typically if long enough continues traversing through the particular sidepanel until it pierces outer wall 8 or 9 of the insulating section 68. This is why outer walls 8, 9 of the insulating section 68 preferably are formed with thicker dimensions as shown best in FIG. 6. Thus, in this flange mounted arrangement, the fastener travels in a direction substantially parallel to the surface of the top wall 62. In the center mounted arrangement described earlier, the fastener travels in a direction substantially perpendicular to the surface of the top wall 62.

As shown in FIGS. 3 and 4, the outer flanges 74, 76 may act as a furring strip for attaching interior and exterior finishing materials to the wall, as well as provide an indication of fastener locations. Specifically, in flange mounted arrangements, the installer knows to locate the fasteners above score lines 78, 80 in order to contact wall 10 or 12.

Figure 5:
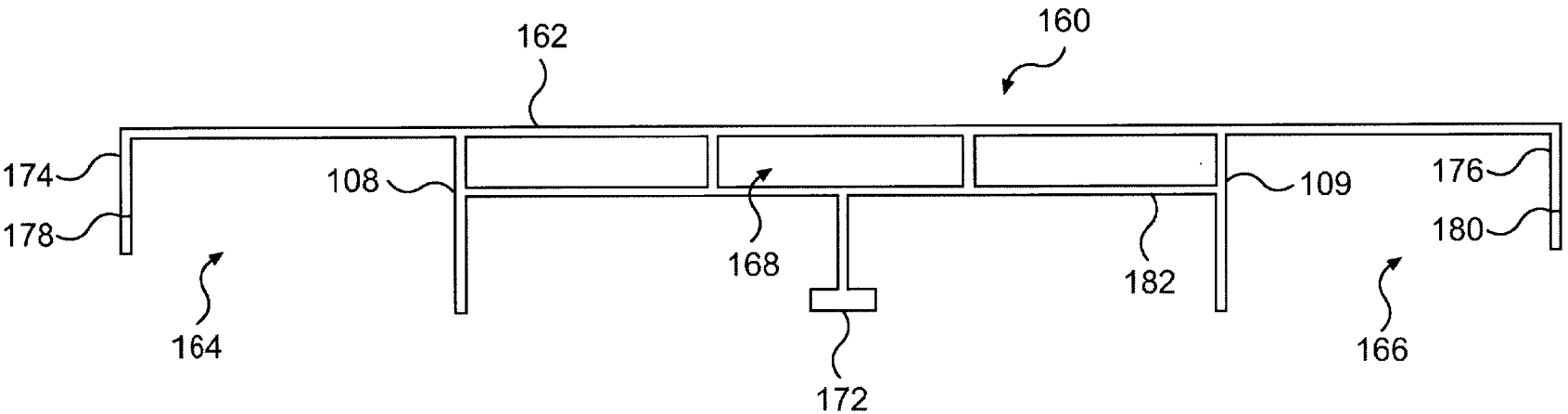
FIG. 5 is a transverse, cross-sectional view of a buck made in accordance with a second embodiment of the invention.

FIG. 5 is a cross-sectional view of a buck in accordance with a second embodiment of the invention. Like reference numerals have been used to designate similar parts, and only aspects of the design that differ from the previous embodiment are discussed in detail herein. The buck 160 of this embodiment differs from the first embodiment primarily in that it has only one anchoring fin 172 and only one row of chambers within section 168.

Figure 6:
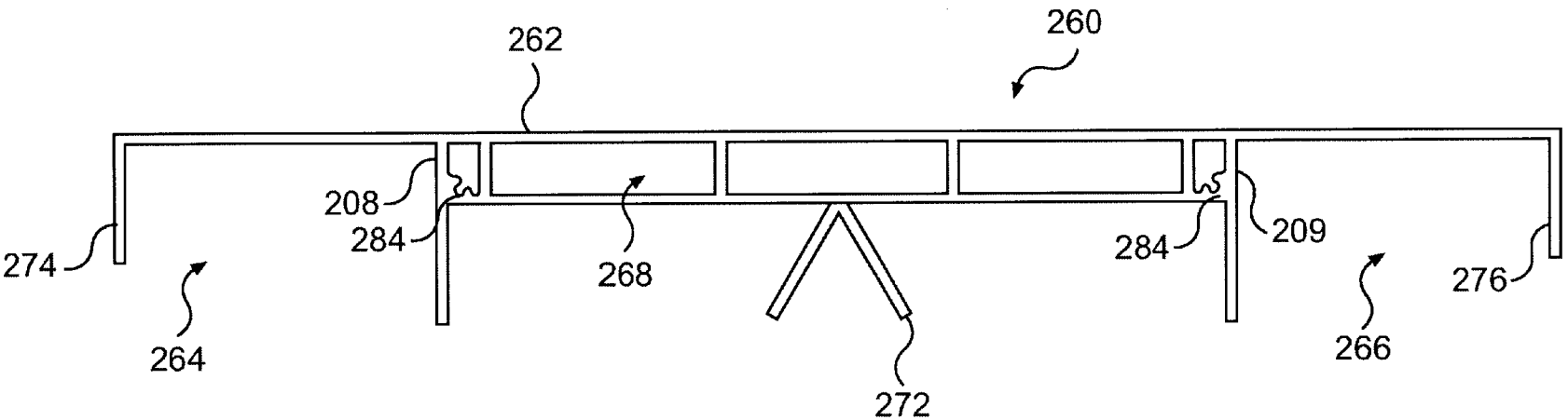
FIG. 6 is a transverse, cross-sectional view of a buck made in accordance with a third embodiment of the invention.

FIG. 6 is a cross-sectional view of a buck in accordance with a third embodiment of the invention. Like reference numerals have been used to designate similar parts, and only aspects of the design that differ from the previous embodiment are discussed in detail herein. The buck 260 of this embodiment differs from the previous embodiments primarily in that its anchoring fin 272 is of a V-shaped as opposed to the T-shape of the previous embodiments. Also, section 268 has a pair of outer chambers with thickened receiving members 284 for offering a more secure anchoring of a fastener within the wall of section 268 at that location.

Although use of the various buck embodiments of the invention should be readily apparent to those skilled in the art from the above detailed description, a suitable method for using such a buck to form an opening within a poured concrete wall will now be described in conjunction with FIG. 7 and an insulated concrete form of the type described in FIG. 1.

Figure 1:
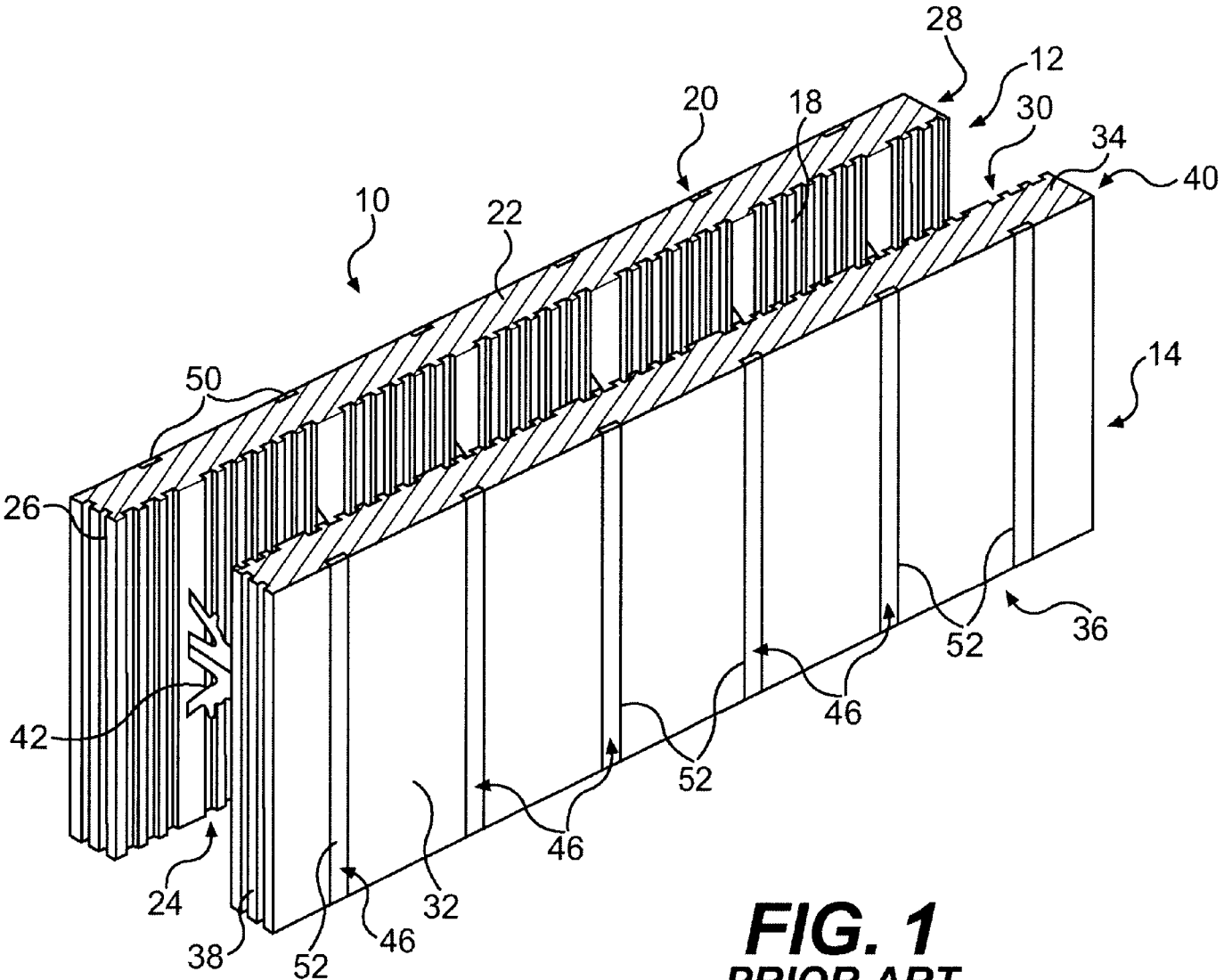
FIG. 1 PRIOR ART
FIG. 1 is a perspective view of a building component used in the construction of an insulated concrete form for building concrete walls.

FIG. 7 shows the buck 60 of FIGS. 3 and 4 mounted on sidepanels 12 and 14 of FIG. 1, however, it is apparent that similar procedures could be used for the other embodiments illustrated herein. The buck 60 is mounted over the first and second sidepanels 12 and 14 of the ICF. Sidepanel 12 is received within and frictionally engaged by first sidepanel receiving section 64. Sidepanel 14 is received within and frictionally engaged by the second sidepanel receiving section 66. After concrete 300 is poured between the first and second sidepanels to cause the concrete to fill in between the first and second sidepanels 12 and 14, it also flows around and eventually hardens about the anchoring fins 72 of the buck 60, thus firmly securing the buck 60 into place on the now permanent ICF and concrete wall.

A framed opening within the ICF wall is formed by frictionally attaching four bucks 60 to form the top, bottom, and two sides of a buck frame around the perimeter of an opening within the formwork in a manner similar to that shown in FIG. 2. This buck frame, being frictionally attached to the formwork, will retain the subsequently poured concrete within the wall and also provide solid attachment surfaces for the component to be mounted within the opening. This is because the friction fit will result in the buck staying in place during assembly. Despite the advantage of the friction fit of this invention, fiber tape may still be used, as it is with prior art bucks, to form an even more secure attachment of the buck to the form while the concrete is setting. Moreover, for large wall openings, it is recommended that bracing is placed within the opening to resist the force of the wet concrete. Bracing is preferably placed approximately every 30 inches within the opening in such a large wall opening for providing additional support.

Once the opening in the wall is so formed, a component, such as a window or a door, for example, may be mounted within the opening by securing the component to the top wall 62 of the buck 60 using at least one fastener, such as a screw, for example. The fastener is received and anchored within the walls and chambers of the multi-chambered section 68 and the component may be either side (flange) or center-mounted as described above.

What is claimed is:

1. A method of making framed openings in a poured concrete wall made with permanent concrete formwork including first and second parallel and spaced sidepanels, said method comprising the steps of:

constructing permanent concrete formwork having an opening;

providing plastic bucks, each having at least one insulating chamber and each having first and second sidepanel receiving sections;

frictionally attaching the bucks to the perimeter of the concrete formwork forming the framed opening by engaging the first sidepanel to the first sidepanel receiving section and engaging the second sidepanel to the second sidepanel receiving section; and pouring concrete into the formwork.

2. The method as claimed in claim 1, wherein the bucks further include at least one anchoring fin and said pouring concrete step comprises pouring concrete around the at least one anchoring fin to firmly connect the buck to the wall.

3. The method as claimed in claim 1, further comprising the step of mounting a component directly to the bucks.

4. The method as claimed in claim 3, wherein said component mounting step directly attaching a component to the bucks by a fastener that is received within at the bucks.

5. The method as claimed in claim 4, wherein said component mounting step completely receiving the fastener within said at least one insulating chamber such that does not penetrate into the concrete.

6. The method as claimed in claim 1, further comprising the step of directly attaching material to at least one of the bucks.

7. The method as claimed in claim 1, further comprising the step of using a score line for indicating at least one of a fastening and cutting location.

8. The method as claimed in claim 1, further comprising the step of forming the plastic at least one rib for frictionally engaging a component to be mounted in the opening.

9. The method as claimed in claim 1, further comprising the step of providing racing as needed to resist the force of poured concrete until the concrete cures.

10. A retainer for forming and framing an opening in permanent concrete formwork defined between at least first and second parallel and spaced sidepanels, said retainer being formed from a synthetic, insulating material and comprising:

a mounting portion having a first surface for supporting a component to be mounted in the opening and a second surface for forming a seal to contain concrete within the concrete form work;

a first sidepanel receiving section, for engaging within the retainer the first parallel and spaced sidepanel, and being connected to one end of said mounting portion; and a second sidepanel receiving section, for engaging within the retainer the second parallel and spaced sidepanel, and being connected to another end of said mounting portion.

11. The retainer as claimed in claim 10, wherein said first sidepanel receiving section is configured to frictionally engage the first sidepanel and the second sidepanel receiving section is configured to frictionally engage the second sidepanel.

12. The retainer as claimed in claim 10, further comprising:

a fastener receiving section disposed between the first and second sidepanel receiving sections for receiving and anchoring at least one fastener adapted to secure the component to said mounting portion.

13. The retainer as claimed in claim 10, further comprising a plurality of insulating chambers.

14. The retainer as claimed in claim 13, wherein said insulating chambers are configured to receive and retain fasteners.

15. The retainer as claimed in claim 13, wherein said plurality of chambers are disposed adjacent to each other in at least two rows.

16. The retainer as claimed in claim 10, further comprising at least one anchoring fin disposed between said first and second sidepanel receiving sections to hold the retainer in place once the poured concrete around the anchoring fin hardens.

17. The retainer as claimed in claim 16, wherein said at least one anchoring fin is of a T-shape.

18. The retainer as claimed in claim 10, wherein said insulating material is plastic.

19. The retainer as claimed in claim 18, wherein said plastic is polyvinyl chloride (PVC).

20. The retainer as claimed in claim 10, wherein said first and second sidepanel receiving sections comprise furring strips providing attachment surfaces for wall finishings.

21. The retainer as claimed in claim 10, wherein said first and second sidepanel receiving sections each include a score line for indicating a cutting location.

22. The retainer as claimed in claim 10, wherein said retainer is one of a window buck and a door buck.

23. The retainer as claimed in claim 10, wherein said first surface includes protuberances for increasing friction.

24. The combination of a retainer as claimed in claim 10 and an insulated concrete form wall defined by first and second sidepanels, said wall having an opening formed and framed by said retainer.

* * * * *